US012710188B2

(12) United States Patent
Dempsey

(10) Patent No.: US 12,710,188 B2
(45) Date of Patent: Aug. 18, 2026

(54) ENHANCED HVAC PERFORMANCE MONITORING SYSTEM AND METHOD THEREOF

(71) Applicant: Daniel J Dempsey, Carmel, IN (US)

(72) Inventor: Daniel J Dempsey, Carmel, IN (US)

( * ) Notice: Subject to any disclaimer, the term of this patent is extended or adjusted under 35 U.S.C. 154(b) by 578 days.

(21) Appl. No.: 18/085,297

(22) Filed: Dec. 20, 2022

(65) Prior Publication Data

US 2023/0194113 A1 Jun. 22, 2023

Related U.S. Application Data

(60) Provisional application No. 63/291,729, filed on Dec. 20, 2021.

(51) Int. Cl.

| | |
|---|---|
| ***F24F 11/49*** | (2018.01) |
| ***F24F 11/46*** | (2018.01) |
| ***F24F 11/62*** | (2018.01) |
| ***F24F 11/64*** | (2018.01) |
| ***F24F 11/76*** | (2018.01) |
| *F24F 11/52* | (2018.01) |
| *F24F 110/10* | (2018.01) |

(Continued)

(52) U.S. Cl.

CPC ..... *F24F 11/49* (2018.01); *F24F 11/46* (2018.01); *F24F 11/62* (2018.01); *F24F 11/64* (2018.01); *F24F 11/76* (2018.01); *F24F 11/52* (2018.01); *F24F 2110/10* (2018.01); *F24F 2110/12* (2018.01); *F24F 2110/20* (2018.01); *F24F 2110/22* (2018.01)

(58) Field of Classification Search

CPC .. F24F 11/30; F24F 11/32; F24F 11/36; F24F 11/38; F24F 11/42; F24F 11/46; F24F 11/49; F24F 11/52; F24F 11/523; F24F 11/56; F24F 11/58; F24F 11/62; F24F 11/63; F24F 11/64; F24F 11/72; F24F 11/77; F24F 11/84; F24F 11/86; F24F 11/89; F24F 12/001

USPC ..... 700/276

See application file for complete search history.

(56) References Cited

U.S. PATENT DOCUMENTS 8,902,071 B2 * 12/2014 Barton ..... F24F 11/30 374/10

9,551,504 B2 * 1/2017 Arensmeier ..... F24D 5/12

(Continued)

FOREIGN PATENT DOCUMENTS

ES 2897873 T3 * 3/2022 ..... F24F 11/63

*Primary Examiner* — Crystal J Barnes-Bullock

(74) *Attorney, Agent, or Firm* — Gutwein Law; Tyler B. Droste

(57) ABSTRACT

A system and method of monitoring the performance of an HVAC system including a controller in communication with an HVAC unit where the method includes monitoring environmental conditions using a controller. Environmental conditions, such as indoor air temperature, indoor humidity and outdoor temperature are measured and used to compute performance parameters that help diagnose HVAC performance problems. The rate of change of indoor air temperature (IATR) and rate of change of indoor humidity (IDHR) are computed and used to determine the sensible heat ratio of the cooling system. The sensible heat ratio, which may or may not be adjusted for transient startup, is used in concert with product performance data, indoor air temperature, indoor humidity, and outdoor air temperature to determine cooling system airflow.

20 Claims, 11 Drawing Sheets

| Date | Time | System Setting | Cool Set Temp (F) | Heat Set Temp (F) | Current Temp (F) | Current Humidity (%RH) | Outdoor Temp (F) | Cool Stage 1 (sec) | Heat Stage 1 (sec) | Run time per period | Cooling DT with AC ON | Measure 4 Daily Avg | Measure 4 Daily Avg | Indoor HR grains | 201 HR Cooling ON | 201 HR Rate | 203 Daily Avg HR Rate | 203 Daily Avg HR Rate |
|---|---|---|---|---|---|---|---|---|---|---|---|---|---|---|---|---|---|---|
| 6/30/19 | 16:00:00 | cool | 78 | 78 | 78.6 | 48 | 91.3 | 285 | 0 | 285 | 0 | | 5.123 | 70.7 | 0.000 | | 7.90 | 0.824 |
| 6/30/19 | 16:05:00 | cool | 78 | 78 | 78.7 | 48 | 91.3 | 300 | 0 | 300 | 0 | | 5.123 | 70.9 | 0.000 | | 7.90 | 0.824 |
| 6/30/19 | 16:10:00 | cool | 78 | 78 | 78.4 | 48 | 91.3 | 300 | 0 | 300 | 0.3 | | 5.123 | 70.2 | 0.707 | | 7.90 | 0.824 |
| 6/30/19 | 16:15:00 | cool | 78 | 78 | 78.1 | 47 | 91.3 | 240 | 0 | 240 | 0.3 | | 5.123 | 68.1 | 2.172 | | 7.90 | 0.824 |
| 6/30/19 | 16:20:00 | cool | 78 | 78 | 77.8 | 46 | 91.3 | 0 | 0 | 0 | 0.3 | | 5.123 | 63.0 | 0.000 | 9.21 | 7.84 | 0.825 |
| 6/30/19 | 16:25:00 | cool | 78 | 78 | 77.7 | 46 | 91.3 | 0 | 0 | 0 | 0.1 | 3.200 | 5.101 | 65.7 | 0.000 | | 7.84 | 0.824 |
| 6/30/19 | 16:30:00 | cool | 78 | 78 | 77.8 | 47 | 91.4 | 0 | 0 | 0 | 0 | | 5.101 | 67.6 | 0.000 | | 7.84 | 0.824 |
| 6/30/19 | 16:35:00 | cool | 78 | 78 | 78.2 | 47 | 91.4 | 45 | 0 | 45 | 0 | | 5.101 | 68.5 | 0.000 | | 7.84 | 0.824 |
| 6/30/19 | 16:40:00 | cool | 78 | 78 | 78.6 | 48 | 91.4 | 300 | 0 | 300 | 0 | | 5.101 | 70.7 | 0.000 | | 7.84 | 0.824 |
| 6/30/19 | 16:45:00 | cool | 78 | 78 | 78.7 | 48 | 91.4 | 300 | 0 | 300 | 0 | | 5.101 | 70.9 | 0.000 | | 7.84 | 0.824 |
| 6/30/19 | 16:50:00 | cool | 78 | 78 | 78.4 | 48 | 91.4 | 300 | 0 | 300 | 0.3 | | 5.101 | 70.2 | 0.707 | | 7.84 | 0.824 |
| 6/30/19 | 16:55:00 | cool | 78 | 78 | 78.1 | 47 | 91.4 | 225 | 0 | 225 | 0.3 | | 5.101 | 68.1 | 2.172 | | 7.84 | 0.824 |
| 6/30/19 | 17:00:00 | cool | 78 | 78 | 77.7 | 45 | 92 | 0 | 0 | 0 | 0.4 | 3.077 | 5.031 | 61.4 | 0.000 | 8.86 | 7.81 | 0.823 |

(51) Int. Cl.

| | |
|---|---|
| *F24F 110/12* | (2018.01) |
| *F24F 110/20* | (2018.01) |
| *F24F 110/22* | (2018.01) |

(56) References Cited

U.S. PATENT DOCUMENTS

| | | | | |
|---|---|---|---|---|
| 10,001,289 | B2 * | 6/2018 | Mowris | F24F 11/32 |
| 10,274,945 | B2 * | 4/2019 | Arensmeier | G05B 23/024 |
| 10,534,383 | B2 * | 1/2020 | Zywicki, III | F24F 11/38 |
| 10,935,271 | B2 * | 3/2021 | Reeve | F24F 11/46 |
| 11,874,009 | B2 * | 1/2024 | Dempsey | F24F 11/523 |
| 12,270,561 | B2 * | 4/2025 | Ellis | G05B 13/04 |
| 2024/0302064 | A1 * | 9/2024 | Dempsey | F24F 11/64 |

* cited by examiner

Indoor Air Temp | Indoor Humidity | Outdoor Air Temp | Run-time | Measured IATR (100), per Cycle (101) and Daily Avg (103)

| Date | Time | System Setting | Cool Set Temp (F) | Heat Set Temp (F) | Current Temp (F) | Current Humidity (%RH) | Outdoor Temp (F) | Cool Stage 1 (sec) | Heat Stage 1 (sec) | Run time per period | Cooling DT with AC ON | Measured IATR | Measured Daily Avg IATR |
|---|---|---|---|---|---|---|---|---|---|---|---|---|---|
| 6/30/19 | 16:00:00 | cool | 78 | 78 | 78.6 | 48 | 91.3 | 285 | 0 | 285 | 0 | | 5.123 |
| 6/30/19 | 16:05:00 | cool | 78 | 78 | 78.7 | 48 | 91.3 | 300 | 0 | 300 | 0 | | 5.123 |
| 6/30/19 | 16:10:00 | cool | 78 | 78 | 78.4 | 48 | 91.3 | 300 | 0 | 300 | 0.3 | | 5.123 |
| 6/30/19 | 16:15:00 | cool | 78 | 78 | 78.1 | 47 | 91.3 | 240 | 0 | 240 | 0.3 | | 5.123 |
| 6/30/19 | 16:20:00 | cool | 78 | 78 | 77.8 | 44 | 91.3 | 0 | 0 | 0 | 0.3 | | 5.123 |
| 6/30/19 | 16:25:00 | cool | 78 | 78 | 77.7 | 46 | 91.3 | 0 | 0 | 0 | 0.1 | 3.200 | 5.101 |
| 6/30/19 | 16:30:00 | cool | 78 | 78 | 77.9 | 47 | 91.4 | 0 | 0 | 0 | 0 | | 5.101 |
| 6/30/19 | 16:35:00 | cool | 78 | 78 | 78.3 | 47 | 91.4 | 45 | 0 | 45 | 0 | | 5.101 |
| 6/30/19 | 16:40:00 | cool | 78 | 78 | 78.6 | 48 | 91.4 | 300 | 0 | 300 | 0 | | 5.101 |
| 6/30/19 | 16:45:00 | cool | 78 | 78 | 78.7 | 48 | 91.4 | 300 | 0 | 300 | 0 | | 5.101 |
| 6/30/19 | 16:50:00 | cool | 78 | 78 | 78.4 | 48 | 91.4 | 300 | 0 | 300 | 0.3 | | 5.101 |
| 6/30/19 | 16:55:00 | cool | 78 | 78 | 78.1 | 47 | 91.4 | 225 | 0 | 225 | 0.3 | | 5.101 |
| 6/30/19 | 17:00:00 | cool | 78 | 78 | 77.7 | 43 | 92 | 0 | 0 | 0 | 0.4 | 3.077 | 5.031 |

Fig. 1

Measured IATR (100), per Cycle (101) and Daily Avg (103)

Measured IDHR (200), per Cycle (201) and Daily Avg (203)

Daily Sensible Heat Ratio

| Date | Time | System Setting | Cool Set Temp (F) | Heat Set Temp (F) | Current Temp (F) | Current Humidity (%RH) | Outdoor Temp (F) | Cool Stage 1 (sec) | Heat Stage 1 (sec) | Run time per period | Cooling DT with AC ON | Measured IATR | Measured Daily Avg IATR | Indoor HR grains | ΔHR Cooling ON | 201 ΔHR Rate | 203 Daily Avg ΔHR Rate | 205 SHR Daily |
|---|---|---|---|---|---|---|---|---|---|---|---|---|---|---|---|---|---|---|
| 6/30/19 | 16:00:00 | cool | 78 | 78 | 78.8 | 48 | 91.3 | 285 | 0 | 285 | 0 | | 5.123 | 70.7 | 0.000 | | 7.90 | 0.824 |
| 6/30/19 | 16:05:00 | cool | 78 | 78 | 78.7 | 48 | 91.3 | 300 | 0 | 300 | 0 | | 5.123 | 70.9 | 0.000 | | 7.90 | 0.824 |
| 6/30/19 | 16:10:00 | cool | 78 | 78 | 78.4 | 48 | 91.3 | 300 | 0 | 300 | 0.3 | | 5.123 | 70.2 | 0.707 | | 7.90 | 0.824 |
| 6/30/19 | 16:15:00 | cool | 78 | 78 | 78.1 | 47 | 91.3 | 240 | 0 | 240 | 0.3 | | 5.123 | 68.1 | 2.172 | | 7.90 | 0.824 |
| 6/30/19 | 16:20:00 | cool | 78 | 78 | 77.8 | 44 | 91.3 | 0 | 0 | 0 | 0.3 | | 5.123 | 63.0 | 0.000 | 9.21 | 7.84 | 0.825 |
| 6/30/19 | 16:25:00 | cool | 78 | 78 | 77.7 | 46 | 91.3 | 0 | 0 | 0 | 0.1 | 3.200 | 5.101 | 65.7 | 0.000 | | 7.84 | 0.824 |
| 6/30/19 | 16:30:00 | cool | 78 | 78 | 77.9 | 47 | 91.4 | 0 | 0 | 0 | 0 | | 5.101 | 67.6 | 0.000 | | 7.84 | 0.824 |
| 6/30/19 | 16:35:00 | cool | 78 | 78 | 78.3 | 47 | 91.4 | 45 | 0 | 45 | 0 | | 5.101 | 68.5 | 0.000 | | 7.84 | 0.824 |
| 6/30/19 | 16:40:00 | cool | 78 | 78 | 78.6 | 48 | 91.4 | 300 | 0 | 300 | 0 | | 5.101 | 70.7 | 0.000 | | 7.84 | 0.824 |
| 6/30/19 | 16:45:00 | cool | 78 | 78 | 78.7 | 48 | 91.4 | 300 | 0 | 300 | 0 | | 5.101 | 70.9 | 0.000 | | 7.84 | 0.824 |
| 6/30/19 | 16:50:00 | cool | 78 | 78 | 78.4 | 48 | 91.4 | 300 | 0 | 300 | 0.3 | | 5.101 | 70.2 | 0.707 | | 7.84 | 0.824 |
| 6/30/19 | 16:55:00 | cool | 78 | 78 | 78.1 | 47 | 91.4 | 225 | 0 | 225 | 0.3 | | 5.101 | 68.1 | 2.172 | | 7.84 | 0.824 |
| 6/30/19 | 17:00:00 | cool | 78 | 78 | 77.7 | 43 | 92 | 0 | 0 | 0 | 0.4 | 3.077 | 5.031 | 61.4 | 0.000 | 8.86 | 7.81 | 0.823 |

Fig. 2

301

| EVAPORATOR AIR | | CONDENSER ENTERING AIR TEMPERATURES °F | | | | | | | | |
|---|---|---|---|---|---|---|---|---|---|---|
| | | 75 (23.9) | | | 85 (29.4) | | | 95 (35) | | |
| CFM | EWB °F (°C) | Capacity MBtuh Total | Capacity MBtuh Sensi | Total Sys. KW** | Capacity MBtuh Total | Capacity MBtuh Sensi | Total Sys. KW** | Capacity MBtuh Total | Capacity MBtuh Sensi | Total Sys. KW** |
| | 72 (22.2) | 45.00 | 21.31 | 2.82 | 42.27 | 20.46 | 2.93 | 39.43 | 19.58 | 3.06 |
| | 67 (19.4) | 39.66 | 26.49 | 2.80 | 37.23 | 25.64 | 2.91 | 34.72 | 24.76 | 3.04 |
| 1050 | 63 (17.2)†† | 35.73 | 24.94 | 2.78 | 33.45 | 24.08 | 2.90 | 31.18 | 23.22 | 3.03 |
| | 62 (16.7) | 36.27 | 36.27 | 2.78 | 34.49 | 34.49 | 2.90 | 32.64 | 32.64 | 3.03 |
| | 57 (13.9) | 36.21 | 36.21 | 2.78 | 34.44 | 34.44 | 2.90 | 32.59 | 32.59 | 3.03 |
| | 72 (22.2) | 44.13 | 21.83 | 3.08 | 41.23 | 20.95 | 3.20 | 38.29 | 20.06 | 3.32 |
| | 67 (19.4) | 38.86 | 27.67 | 3.06 | 36.32 | 26.77 | 3.18 | 33.75 | 25.84 | 3.30 |
| 1200 | 63 (17.2)†† | 34.85 | 25.91 | 3.04 | 32.54 | 25.02 | 3.16 | 30.20 | 24.08 | 3.29 |
| | 62 (16.7) | 36.56 | 36.56 | 3.05 | 34.64 | 34.64 | 3.17 | 32.64 | 32.64 | 3.30 |
| | 57 (13.9) | 36.51 | 36.51 | 3.05 | 34.60 | 34.60 | 3.17 | 32.59 | 32.59 | 3.30 |
| | 72 (22.2) | 42.95 | 22.22 | 3.34 | 39.98 | 21.33 | 3.46 | 36.93 | 20.42 | 3.58 |
| | 67 (19.4) | 37.85 | 28.64 | 3.32 | 35.28 | 27.68 | 3.44 | 32.72 | 26.65 | 3.56 |
| 1350 | 63 (17.2)†† | 33.87 | 26.69 | 3.30 | 31.51 | 25.70 | 3.42 | 29.29 | 24.42 | 3.55 |
| | 62 (16.7) | 36.30 | 36.30 | 3.31 | 34.44 | 34.44 | 3.43 | 32.30 | 32.30 | 3.56 |
| | 57 (13.9) | 36.46 | 36.46 | 3.31 | 34.41 | 34.41 | 3.43 | 32.26 | 32.26 | 3.56 |

††Entering Dry Bulb temperature 75 F, all others 80 deg F.

303

Fig. 3

*COOLING* DASHBOARD

| Most Recent Data | Site | Type | T'stat Temp (F) | T'stat RH (%) | Sens Heat Ratio | Avg OAT (F) | Cool Cycle (mins) | Est. CFM / Ton | Current Cool Rate | Flags Prior Week | Standard Cool Rate | Air Leak Factor |
|---|---|---|---|---|---|---|---|---|---|---|---|---|
| 3/17/21 | IN RonH | AC1 | 72 | 42 | | 35 | --- | | | 0 | 0.0 | 1 |
| 9/18/21 | IN Kampen | AC1 | 69 | 52 | 1.00 | 71 | 3053 | 308 | 0.4 | 136 | 0.1 | 2 |
| 8/31/20 | IN PG down | AC1 | 75 | 50 | 0.43 | 66 | 37 | 198 | 1.5 | 45 | 0.5 | 7 |
| 7/31/20 | IN PG up | AC1 | 79 | 43 | 0.76 | 70 | 50 | 298 | 3.6 | 0 | 0.9 | 9 |
| 9/18/21 | SC Condo | HP1 | 73 | 51 | 0.60 | 78 | 19 | 289 | 3.0 | 3 | 2.3 | 51 |
| 9/18/21 | IN TownH | AC1 | 69 | 44 | 0.68 | 71 | 9 | 302 | 4.2 | 0 | 3.0 | 18 |
| 5/27/21 | OH DaveW | HP1 | 73 | 52 | 0.75 | 71 | 7.8 | 388 | 7.9 | 0 | 4.2 | 30 |
| 9/18/21 | OH Office | AC1 | 77 | 45 | 0.73 | 72 | 10 | 304 | 6.4 | 0 | 4.3 | 34 |
| 9/18/21 | OH Condo | AC1 | 76 | 47 | 0.69 | 72 | 13 | 304 | 5.6 | 0 | 4.5 | 7 |
| 9/18/21 | FL Condo | AC1 | 78 | 52 | 0.82 | 79 | 5.7 | 449 | 9.3 | 0 | 8.1 | 37 |
| 8/31/20 | FL PG | AC1 | 86 | 61 | 0.87 | 84 | 13 | 315 | 17 | 0 | 8.4 | 28 |

Fig. 5

ENHANCED HVAC PERFORMANCE MONITORING SYSTEM AND METHOD THEREOF

CROSS-REFERENCE TO RELATED APPLICATION

This U.S. Patent Application claims priority to priority to U.S. Provisional Application: 63/291,729 filed Dec. 20, 2021, the disclosure of which is considered part of the disclosure of this application and is hereby incorporated by reference in its entirety.

FIELD OF THE INVENTION

This invention relates generally to heating, ventilation, and air conditioning (HVAC) systems. In one aspect, the invention relates to a system and a method for monitoring an HVAC system, including the determination of performance parameters used for diagnosis of humidity control problems.

BACKGROUND

A HVAC (heating, ventilation, or air conditioning) system controls environmental parameters, such as temperature and humidity, of a residence. The HVAC system may include, but is not limited to, components that provide heating, cooling, humidification, and dehumidification. The target values for the environmental parameters, such as a temperature set point, may be specified by the HVAC owner.

In the HVAC industry, homeowners can encounter many performance issues with their HVAC systems, besides immediate failure due to malfunction. Some of these problems, such as degradation in HVAC system heating and cooling capacity, are identified by the diagnostic method described in U.S. Application 20210302043. Additionally, some manufactures try to use various methods to predict potential product failures by monitoring and/or tracking the rate of change of the indoor air temperature when the HVAC system is operating, ("IATR"). When an HVAC system approaches peak load operation (i.e., at very high outdoor air temperatures in cooling, and very low temperatures in heating), the system reaches a stable condition where the IATR is zero and the system runs constantly. Conversely, when the system is operating constantly at less than peak load, an IATR value of zero or less can signify a performance problem and trigger an alert to the homeowner or contractor.

The challenge in tracking IATR is that, at part load, the HVAC system cycles ON/OFF under a wide range of environmental conditions and produces a varying degree of IATR. This varying amount of IATR change rate causes scatter and makes tracking system performance degradation difficult, other than when IATR reaches zero. Thus, the individual IATR data points must be averaged over a period of time, typically over days or weeks, so as to establish a trend. However, many of the current systems do not account for other possible variables or include a range of various environmental conditions when correcting the IATR and similarly are unable to accurately correct for these variables when predicting performance degradation of the HVAC system.

While current methods identify, in a quantitative manner, the temperature control performance of a heating or cooling system, these methods fail to provide any insight as to the control of humidity in the conditioned space. Specifically, parameters such as cooling system airflow and relative flow of outside air into the conditioned space are computed. The methodology described in the present disclosure pertains to non-communicating HVAC equipment and uses data communicated by smart thermostats and/or other wireless sensors communicatively coupled to an HVAC system. The methodology and system of the present disclosure can be executed utilizing existing smart thermostats without the need for additional sensors or HVAC systems containing built-in sensors.

Additionally, the method of the present disclosure provides the servicing HVAC contractor measures of system circulating airflow during cooling operation and flow of outside air into the conditioned space, both critical to the diagnosis of humidity control problems in a home.

For example, if the humidity in a home is measured to be high during cooling operation and the airflow is also high, then the servicing contractor immediately knows to look at blower speed setting as dehumidification capacity decreases quickly as airflow increases. Conversely, if the humidity in the home is measured to be high during cooling operation and the airflow is not high, then the servicing contractor would look for contributors to high moisture loads, such as outside air leaks or sources of high internal moisture (cooking, water in the basement, etc). If the leakage outside air into the conditioned space was also measured to be high, as per the method described in this application, the servicer would then focus on mitigating high outside air leakage rather than looking for high internal moisture loads.

BRIEF SUMMARY OF THE INVENTION

In one aspect, the present disclosure is related to a method of monitoring and/or determining the performance of an HVAC system. One or more controllers can record or determine various data elements in during a prescribed time period or interval. In some embodiments, the data elements can include outdoor air temperature, indoor air temperature, indoor air temperature rate, indoor relative humidity, system on or off status, system cycle (i.e., heating or cooling), airflow, outdoor humidity, barometric pressure, wind, solar irradiance, among others. The controller includes a sensor for obtaining the measurement or be communicatively coupled to one or morse sensors to collect the data elements. The dehumidification rate, humidification rate, cooling airflow and rate of outside airflow into the conditioned space can be computed from one or more data elements or measured by the controller or a sensor.

A threshold value for the various data elements can be established or set, wherein if any of the computed rates reach the threshold value, the system can trigger an alert to a user or device. In some exemplary embodiments, the system may require the rates to be at the or exceed the threshold value for a period of time or interval before triggering an alert. The alert can be communicated in any suitable means, including but not limited to a graphical user interface such as a computer monitor or smart phone, a text, email, call, audio alert, or any other suitable means. Additionally, the alert can be transmitted to a user to inform them of the HVAC status and potential service issue or maintenance check of the HVAC system. Similarly, the controller can generate a one or more reports or graphical charts to illustrate the tracking of the rates and other data elements of the system.

In yet another aspect, the present disclosure provides a method for monitoring HVAC system performance system using a thermostat having a transceiver for communicating with a wireless network to a monitoring system comprising a monitoring system controller. The method can include first operating an HVAC system using the HVAC controller, wherein the HVAC controller can be any suitable means computer, "smart" thermostat, or remote controller communicatively coupled to the HVAC system. In some exemplary embodiments, the HVAC controller can be communicatively coupled to or include a processing means and memory. In other embodiments, the smart thermostat can operate as the HVAC controller. Additionally, the system controller can include a transceiver capable of connecting to a network, such as a wireless network and be communicatively coupled to the monitoring system controller.

In some exemplary embodiments, the HVAC controller can include or be communicatively coupled to at least one sensor for collecting data values for one or more environmental factors at a prescribed interval. In some exemplary embodiments, a "smart" thermostat can operate as both the HVAC controller and the monitoring system controller. It is understood that in some embodiments, the HVAC system can include more than one HVAC controller. A monitoring system controller can then generate a dehumidification rate, humidification rate, cooling airflow and/or measure of outside airflow rate into the conditioned space for the predetermined time interval based upon the collected data values of the environmental factors during the prescribed interval. The monitoring system can then analyze the rates in reference to the HVAC system performance values at one or more prescribed intervals. These rates can be plotted over a timeline to monitor for any potential degradation or perturbation. Additionally, if either of the rates reach a certain threshold value, the monitoring system can initiate an alert to a user using any suitable method. In some embodiments, the alert can be a text, email, alarm, or other notification. In some embodiment, the alert can be transmitted to a user devices or graphical display, such as a smart phone, tablet or computer. In addition to being obviously visible to an HVAC contractor monitoring the system, an alert signal can also be generated and/or communicated if the if either of the rates fall outside a predetermined performance tolerance threshold value.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

FIG. 1 is a table containing raw data obtained and representative calculation outputs using an exemplary method of the present disclosure using a per cooling cycle and rolling daily average indoor air temperature change rate (IATR).

FIG. 2 is a table providing raw data obtained and representative calculation outputs using an exemplary method of the present disclosure using a per cooling cycle and rolling daily average IATR and indoor humidity change rate (IDHR).

FIG. 3 is an example of published air conditioner performance data of a standard air conditioning HVAC system.

FIG. 5 is an example of a contractor system monitoring dashboard of an exemplary embodiment of a system of the present disclosure.

DETAILED DESCRIPTION OF THE INVENTION

Figure 4:
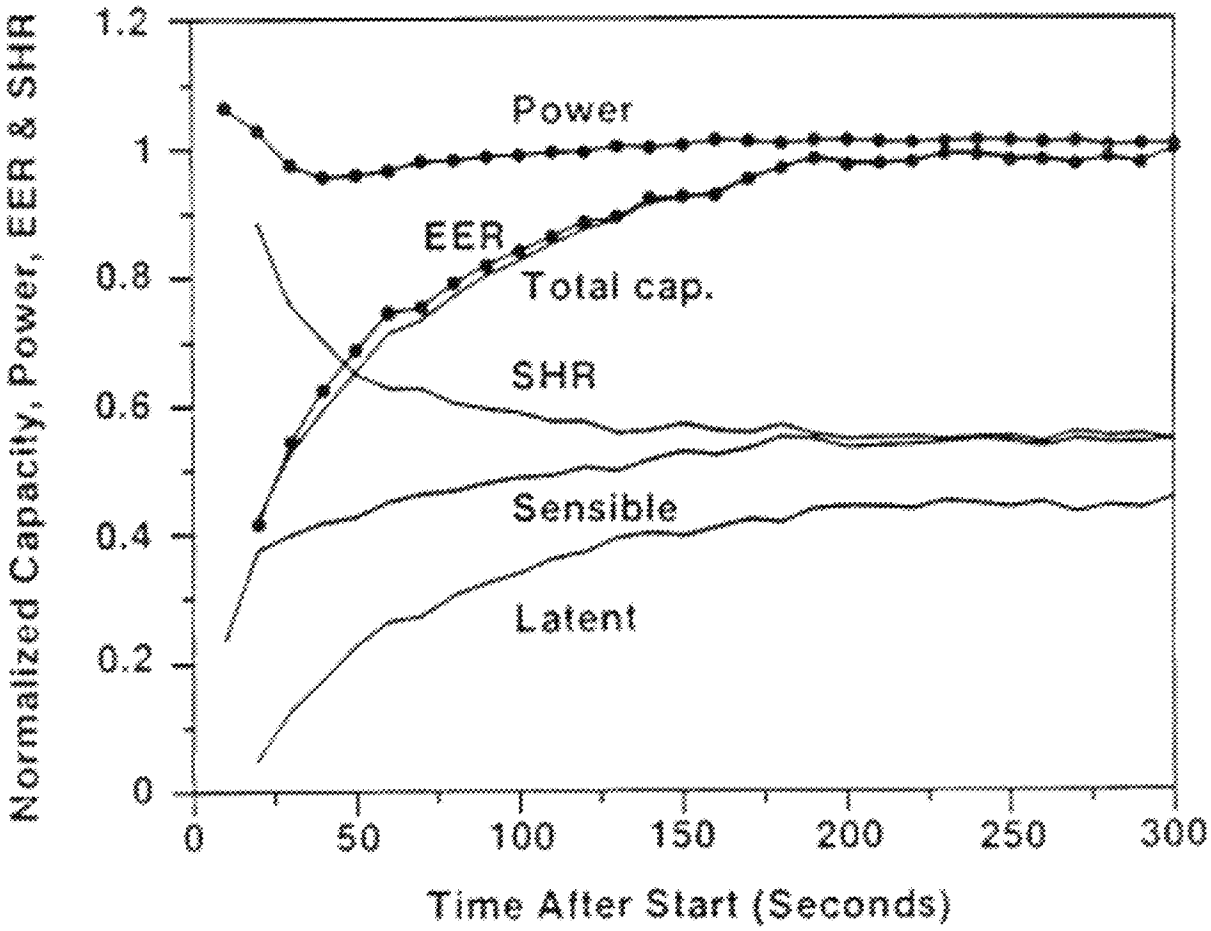
FIG. 4 is a plot of sensible heat ratio as a function of time during a cooling cycle of a standard HVAC unit.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS., with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Some smart thermostats including transceiving capabilities utilizing various communication means, including but not limited to WiFi, can include a website for customers and servicing contractors that allow the downloading of system configuration and operational data. The data that is made available to those authorized to receive it includes system configuration parameters such as type of system (single vs. two stage), thermostat setpoints and operational schedule, system location among other data parameters. Operational data includes indoor air temperature and relative humidity, outdoor air temperature and relative humidity, system runtime for each stage, mode of operation (heating vs cooling) and other parameters available for download.

As described in a prior filing titled, U.S. patent application Ser. No. 17/151,246 tiled "Improved HVAC Performance Tracking" and incorporated in its entirety by reference, the configuration and operational data is used to monitor HVAC system performance using the change in indoor air temperature (IATR) during each heating and cooling cycle. When an HVAC system approaches peak load operation (i.e., at very high outdoor air temperatures in cooling (negative rate of change), and very low temperatures in heating (positive rate of temperature change)), the system reaches a stable condition where the IATR is zero or less, on an absolute basis, and the system runs constantly. Conversely, when the system is operating constantly at less than peak load, an IATR value of greater or less can signify a performance problem and trigger an alert to the homeowner or contractor. The tracking of IATR provides insight to the thermal performance of a heating or cooling system (i.e., ability to heat or cool air), but fails to provide insight as system airflow or flow of outside air into the conditioned space.

FIG. 1 provides data obtained and generated by an exemplary embodiment of the system of the present disclosure to determine IATR values 100. The system can compute IATR on a per cycle basis IATR 101 and/or a daily average IATR 103. FIG. 2 shows an expanded data that includes a computation of dehumidification rate of change of indoor humidity (IDHR) 200, as displayed in column titled, "ΔHR Rate", for each cooling cycle 201 and also a daily average IDHR 203. In some exemplary embodiments, the IDHR 200 can be determined using Equation 1 where absolute humidity ($HR_i$) is calculated from indoor air temperature and indoor relative humidity.

$$IDHR = (HR_{i+1} - HR_i)/\text{Run Time, where} \qquad \text{Equation 1}$$

$HR_i$ is the absolute humidity at time step $i$ $HR_{1+1}$ is the absolute humidity at time step $i+1$ Run−time =

Run−time of $HVAC$ system between time steps 1 and $i+1$

In some exemplary embodiments, the IDHR 200 can then be averaged over a 24-hour period to create a daily IDHR rate 203. In this embodiment, IDHR can be represented as grains of moisture per hour of run-time to facilitate the calculation of dehumidification capacity in British thermal units (BTUs). A similar calculation can be made for humidification to track the performance of a humidification system during heating operation, or a standalone dehumidifier, regardless of heating or cooling operation. For exemplary purposes of this disclosure, all examples described herein will pertain to dehumidification during cooling operation but should be understood that the same methodology can be used for humidification operations.

FIG. 3 illustrates typical cooling performance data published by an air conditioner manufacturer of an HVAC system. The system performance data includes the sensible and total cooling capacities as a function of indoor air dry-bulb temperature, indoor wet-bulb temperature 301, outdoor air temperature and airflow. The difference between sensible and total capacity is the latent (dehumidification) capacity. The relative measure of sensible to latent capacity can be characterized as the "Sensible Heat Ratio" where the sensible capacity is divided by the sum of sensible and latent capacities. The Sensible Heat Ratio tends to decrease as airflow decreases and when entering wet bulb air temperature 301 increases. Data points 303 shown in FIG. 3 illustrates one set of conditions at 1200 cfm and 95° F. OAT that correspond to a 0.797 Sensible Heat Ratio. In general an ideal specification for an HVAC system is a target of 0.75 Sensible Heat Ratio to provide optimal balance of temperature and humidity control.

Once the IATR 100 and IDHR 200 are established, the IATR 100 and IDHR 200 can be used to calculate Sensible Heat Ratio using the simplified relationship in Equation 2 or Equation 3.

$$SHR = \frac{\text{Sensible Btu/hr}}{\text{Sensible Btu/hr} + \text{Latent Btu/hr}} \quad \text{Equation 2}$$

$$SHR = \frac{1.085 * IATR}{1.085 * IATR + 1061 * (IDHR/7000)} \quad \text{Equation 3}$$

In the one exemplary embodiment illustrated above, a daily average of IATR and IDHR values can be used. The system can also use IATR and IDHR from each individual heating/cooling cycle or averaged over a different time-period (hour, week, etc.) as illustrated in FIG. 2. In some exemplary embodiments, the time-period can be a pre-determined time established by a user. More sophisticated relations to compute sensible and latent energy can also be used.

Once the Sensible Heat Ratio is determined, a system circulating airflow value can be determined using the product data or system data.

In one exemplary embodiment, the indoor wet-bulb temperature can first be computed using the measured indoor air dry-bulb and indoor relative humidity. Using one or more interpolation techniques, the airflow that corresponds to the measured indoor air dry-bulb and wet-bulb temperatures, outdoor air temperature and sensible heat ratio can be determined. Conversely, the entering wet bulb temperatures in the product data can be converted to humidity, and similar interpolation techniques can be applied directly with measured indoor humidity.

By way of example where the average indoor dry bulb is measured to be 75° F., average indoor relative humidity 51%, average outdoor air temperature 80° F., and average Sensible Heat Ratio computed to be 0.740. The indoor wet bulb for these conditions is 63° F. and corresponds to the data highlighted in the three double-lined boxed areas in FIG. 3. The Sensible Heat Ratio for each airflow condition at 63° F. entering wet bulb is computed and summarized in Table 1, with the interpolated values for an 80° F. outdoor temperature shown in the right column.

TABLE 1

| | 75° F. OAT | 85° F. OAT | 80° F. OAT |
|---|---|---|---|
| 1050 CFM | 24.94/35.73 = 0.698 | 24.08/33.45 = 0.720 | 0.709 |
| 1200 CFM | 25.91/34.85 = 0.743 | 25.02/32.54 = 0.769 | 0.756 |
| 1350 CFM | 26.69/33.87 = 0.788 | 25.70/31.51 = 0.816 | 0.802 |

Interpolating the data in the 80° F. outdoor air temperature column for a 0.740 Sensible Heat Ratio results in 1149 CFM, or 383 CFM/ton for this three-ton system.

In one exemplary method of the present disclosure for estimating system circulating airflow values, the system assumes a fully steady state operation because that is how the sensible and total cooling capacities in FIG. 3 are determined by the manufacturer. In alternative exemplary methods and in actual operation, however, the sensible heat ratio may vary as the system reaches steady state, beginning at a higher value then decreasing as water vapor condenses and wets the coil. FIG. 4 illustrates the aforementioned affect as it was taken from a research report by a public organization, where the change in sensible and latent performance is plotted as a function of time.

To account for the transient behavior, especially for systems with short cooling run-times, the measured SHR can be adjusted based on average run-time using the relationship: $SHRss=SHRmeas*(1-e^{-kt})$ where SHRss is the value applied to the manufacturer's product performance data, SHRmeas is the measured Sensible Heat Ratio, C and k are constants that fits the relation to system transient performance, and t is the average length of cooling ON cycle in secs. Value for k can be approximately 0.025, but can vary with system type (capacity, efficiency, configuration, refrigerant, etc.). The above referenced equation can be utilized for SHR based upon the run time of the HVAC system. Alternatively, cycles within pre-determined set values can be utilized for aiding in adjusting for any transient behavior of the system. In some exemplary embodiments, a circulating airflow value can be determined by generating SHR values at intervals during the performance evaluation cycle using a performance analysis algorithm and at least one environmental factors, including but not limited to obtained environmental data, historical measured performance data for the HVAC system, and manufacturer system performance product data. An SHR value can be adjusted to an equivalent steady state value based on an average system run-time per cycle to account for startup transient. Similarly, SHR values used to generate the circulating airflow value are based upon SHR values within a pre-determined range.

Once IATR, IDHR, SHR and airflow values are computed, the measurements can be displayed in a Contractor System Monitoring Dashboard on a display of the system as shown in FIG. 5. In addition to these values, other key data can be displayed, such as average indoor air temperature, indoor relative humidity, average outdoor air temperature, average run-time per cycle, and the adjusted IATR value (Standard Cool Rate) calculated using the method described in U.S. Application 20210302043. Helpful flags, alerts, alarms, and trend arrows can also be displayed for ease of use by a user. The dashboard can also contain a plotting function to view any of the displayed parameters (either measured or computed) over time.

A dashboard provided on a display can provide other relevant information such as a measure of the flow of outside air into the conditioned space. The measurements can help the system in the diagnosis of humidity control problems of the HVAC system, as well as provide an indication to the servicer and homeowner as to infiltration heating and cooling load and overall energy cost.

Figure 6:
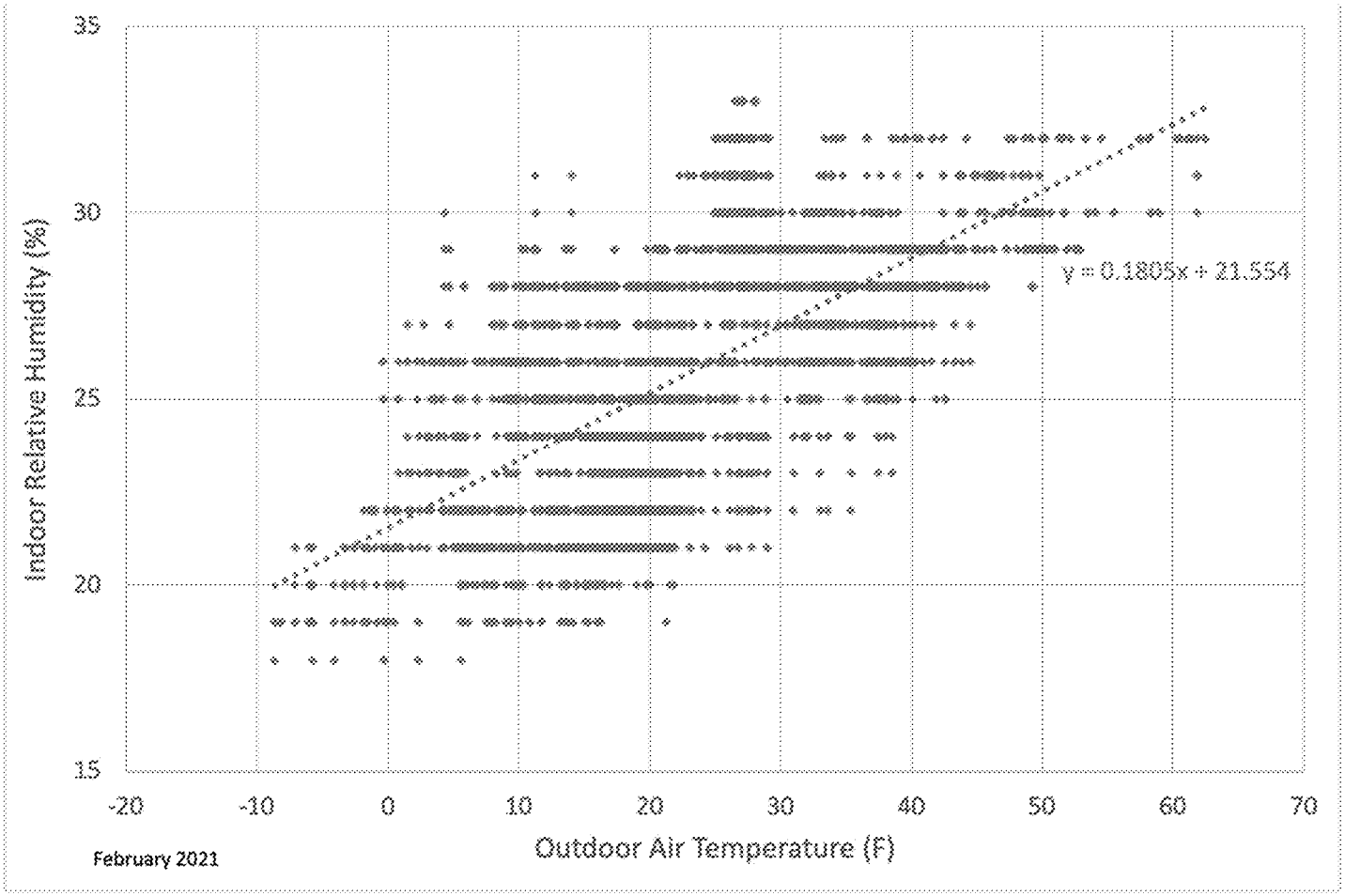
FIG. 6 is a graphical illustration of OAT vs. IDRH for a single-family house in the midwestern United States in February.

FIG. 6 provides a graphical illustration of indoor relative humidity vs. outdoor air temperature during February for a single-family house located in midwestern United States. The dwelling for which the measurements apply utilize no standalone humidification or dehumidification devices and the internal latent load is only a result of moisture from occupants and their activities. The higher the amount of outside air entering the conditioned space, the greater the range of indoor humidity from low-to-high over the course of the month. This is most easily represented by the slope of a best-fit line provided in the graphical illustration. Additionally, drier outside air entering the home can create an increasingly greater slope of the best-fit curve. For example, during the winter in the Midwest, outdoor air tends to be drier than that indoors. As more outside air enters the home, the lower the indoor humidity becomes. Conversely in Summer, outside air tends to have more moisture than that indoors, and as more outside air enters the home, the higher the indoor humidity becomes. The HVAC system can in the summer remove moisture and that moisture can be accounted for when plotting humidity against outdoor air temperature. Other metrics that could be used in place of the best fit slope are the range of minimum to maximum humidity or standard deviation of the humidity measurements.

A house with a lower flowrate of outdoor air into the conditioned space than that shown in FIG. 6 would generally have higher indoor humidity at the lower outdoor air temperatures. This is illustrated by the data from a multifamily condominium unit shown in FIG. 7, where the slope of the best-fit line is only about 40% of the slope of the data from the single-family house. The condominium has only three exterior walls exposed to the outdoors and all ducts are located inside the conditioned space: construction consistent with a reduced amount of outdoor air entering the space. Though occupants and their activities could impact the indoor humidity, both the house depicted in FIG. 6 and condominium depicted in FIG. 7 have two fulltime occupants.

Conversely, a structure that has a higher amount of outside air entering the conditioned space would have lower indoor humidity at the lower outdoor air temperatures. Increased outside air is illustrated in the graphical illustration from a single-story office building shown in FIG. 8, where the HVAC system is located on the roof and has many sources of outside air leakage into the return air circulation system. Compared to the data from the single-family house in FIG. 6, the office building in FIG. 8 has a best-fit slope that is about 2 times greater. Lastly, if a house had no outside air intrusion the slope of the IDRH vs. OAT best-fit line would be zero (flat line), exclusive of moisture generated inside the house by occupants and their activities.

The best-fit slopes can be affected by the time of the year the data is acquired. The prior examples illustrated in FIGS. 6-8 were from February 2021, where the difference between indoor and outdoor air temperatures were near seasonal peak values. These conditions can create the greatest outside air infiltration due to stack effect. If data was acquired in March, then the difference between indoor and outdoor temperature would be less, resulting in lower stack effect, less outside air entering the conditioned space, and thus, a reduced best-fit slope. To compensate for the seasonal variation, the slope values can be normalized to a standard indoor to outdoor air temperature difference using the stack effect equation shown below as Equation 4:

$$Q = C * A * \left[2 * g * h * (IAT - OAT)/IAT\right]^{1/2} \quad \text{Equation 4}$$

Q=Flowrate of outside air entering building due to stack effect

C=discharge coefficient, usually between 0.65 and 0.7

A=Leakage area g=Gravitational constant h=Height from top of space to neutral pressure level, typically half the total height of the interior of the structure.

IAT=Indoor air temperature

OAT=Outdoor air temperature

For example, the average indoor and outdoor temperatures from the data in FIG. 6 are about 67.8° F. and 23.4° F., respectively. To normalize the air flow to average winter conditions for Indiana, a 42° F. average outdoor temperature from November 2020 to March 2021, the measure of outside airflow can be adjusted by the factor generated by equation 5.

$$\text{Adjustment} = \left[(IATmeasured - OATaverage)/(IATmeasured - OATmeasured)\right]^{1/2} \text{ or Adjustment} = \left[(67.8 - 42)/(67.8 - 23.4)\right]^{1/2} = 0.762 \quad \text{Equation 5}$$

In this exemplary embodiment, the outside air flow into the conditioned space, for the average period from about November 2020 to about March 2021, would be about 76% of the measured value for the month of February 2021. The above Equation 5 can be utilized to normalize and/or account for potential air leakage into the conditioned space of the house or dwelling.

Figure 7:
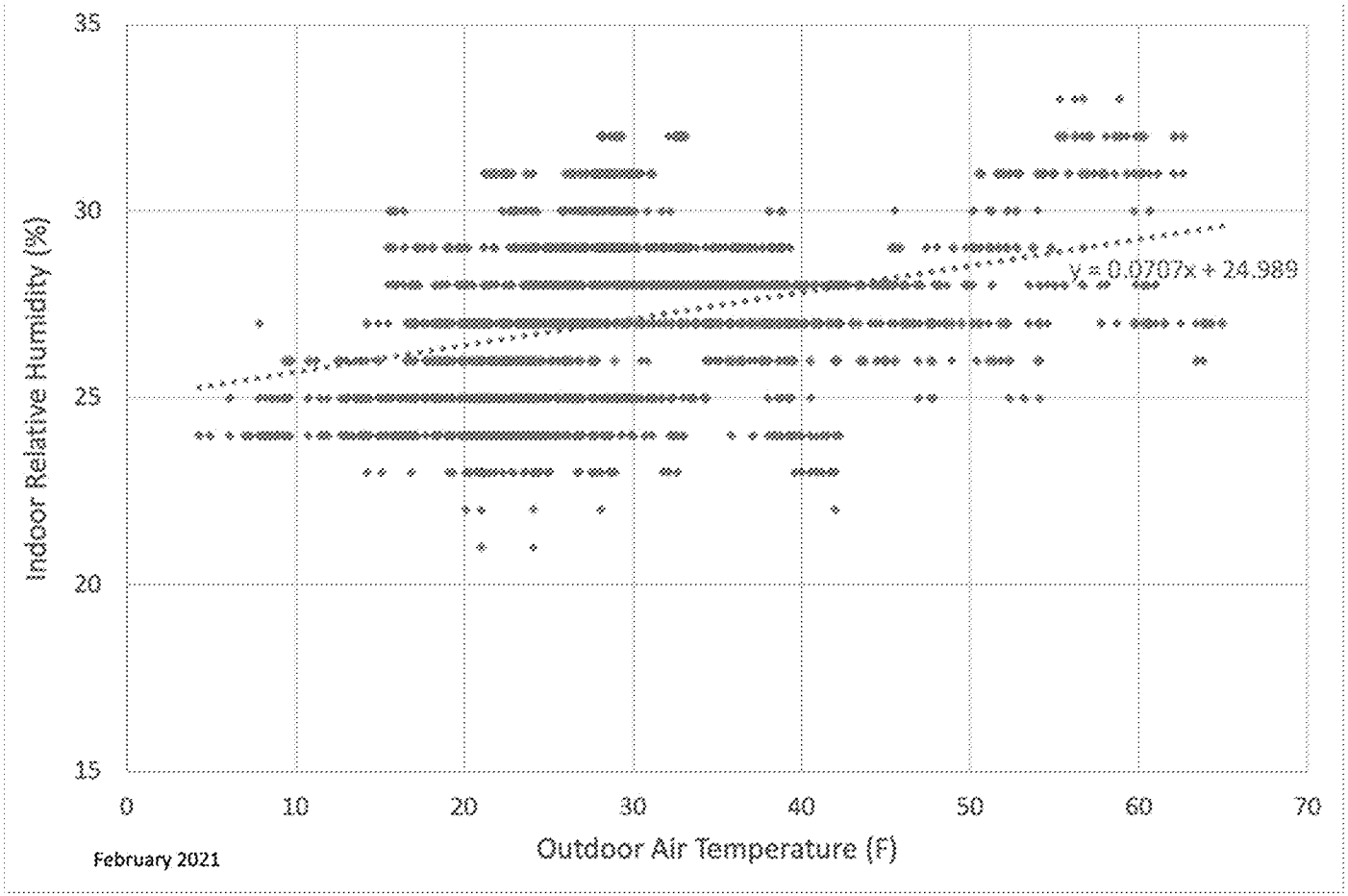
FIG. 7 is a graphical illustration of OAT vs. IDRH for a multifamily condominium unit in the midwestern United States in February.
Figure 8:
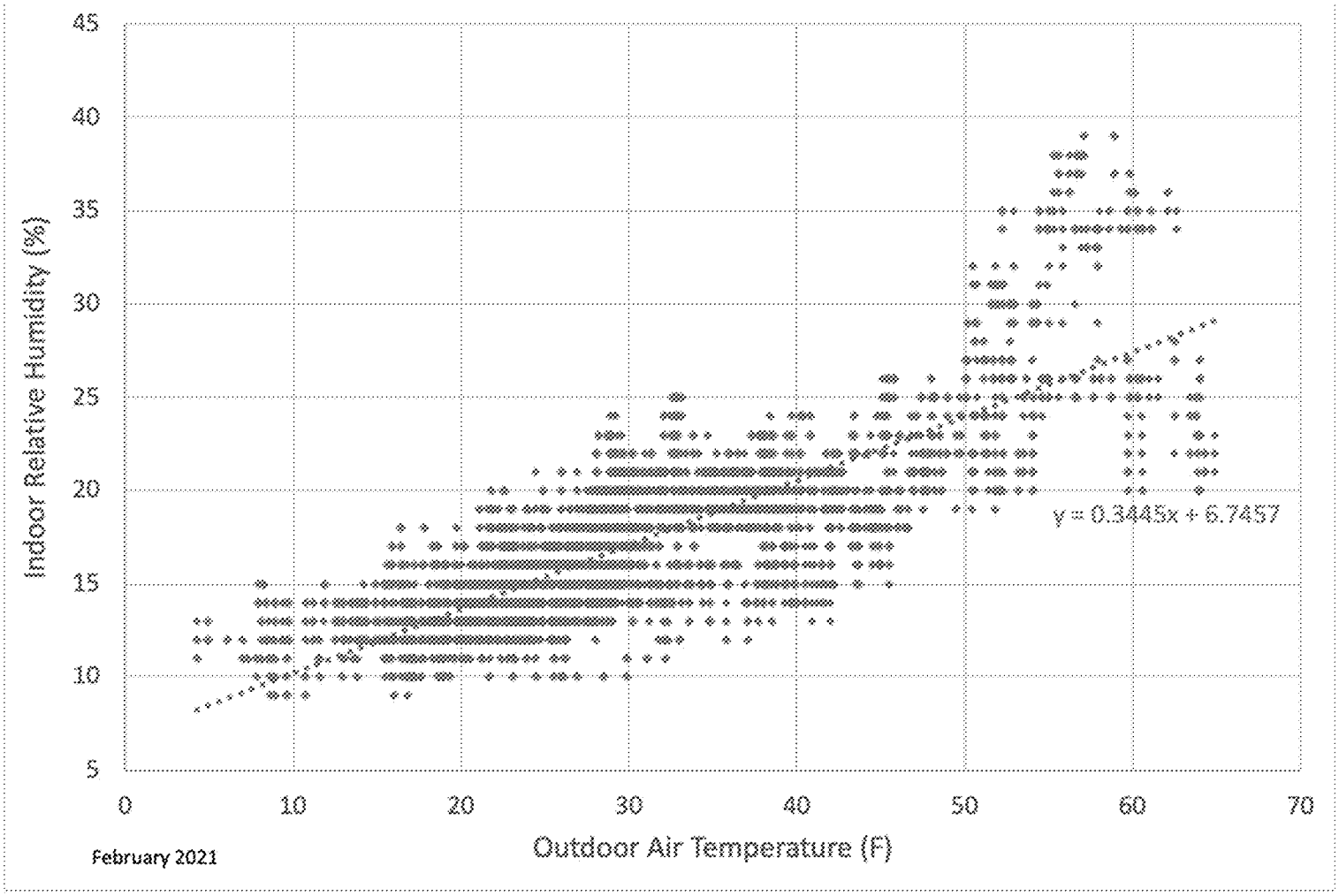
FIG. 8 is a graphical illustration of OAT vs. IDRH for a single-story office in the midwestern United States in February.

The plots illustrated in FIGS. 6-8 show indoor relative humidity plotted against outdoor air temperature, the values which are readily available from the thermostat cloud. In other exemplary embodiment, additional or alternative values can be utilized to track moisture flow, including but not limited to absolute indoor and outdoor humidity. Absolute indoor humidity can be calculated from indoor relative humidity and indoor air temperature, while outdoor humidity may need to be made available in the thermostat manufacturers data cloud or through additional sensors. Regardless of metric used, a resulting best-fit slope can be a relative indicator of the flow of outside air into the conditioned space (i.e., infiltration, ventilation, etc.).

In some exemplary embodiments, a system controller can operate an HVAC system and can monitor the operation of the HVAC system. In some embodiments, the HVAC system can have two separate controllers, a HVAC system controller configured to operate the HVAC system and a monitoring system controller for monitoring the performance of an HVAC system. The monitoring system controller can be communicatively coupled to the HVAC system controller. In some embodiments, the monitoring system controller can be a cloud-based application communicatively coupled to the HVAC system and one or more sensors or databases to collect values of environmental factor variables and performance data to monitor the function and performance of an HVAC system. The monitoring system controller can be communicatively coupled to one or more sensors, such as a "smart" thermostat to collect operational data of the HVAC system as well as environmental variables, such as temperature and humidity during the operation of the HVAC system. In some embodiments, a "smart" thermostat or thermostat having a transceiver capable of communicating over a wired or wireless network can operate as both the HVAC system controller and a sensor. While the HVAC system may cycle on and off, the monitoring system controller can be continuously in operation to collect various data and information of the conditioned environment.

Figure 9:
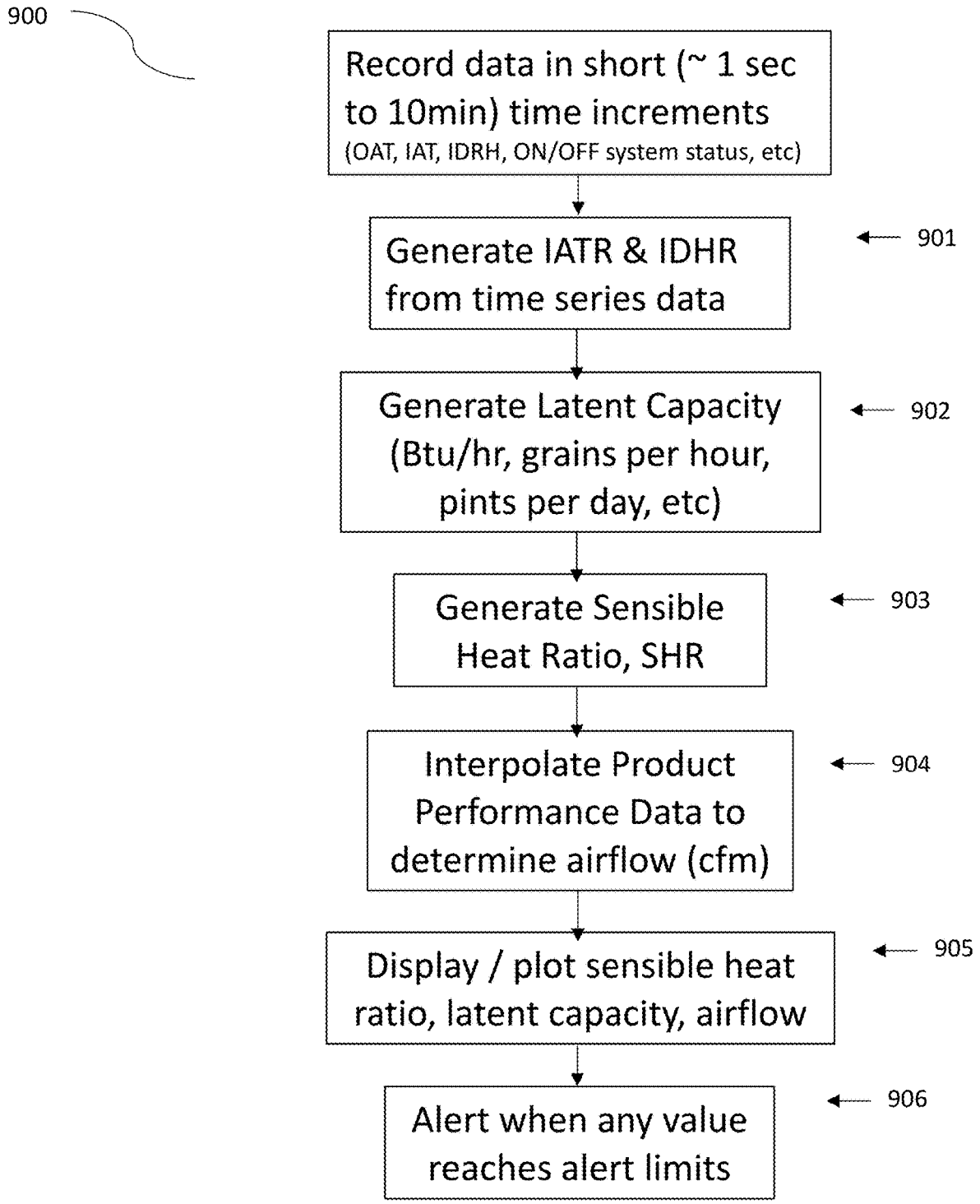
FIG. 9 is a flow chart of an exemplary embodiment of a method for determining sensible heat ratio and cooling airflow of the present disclosure.

FIG. 9 provides an exemplary method 900 for ongoing monitoring HVAC system performance using a monitoring system controller communicatively coupled to an HVAC system. The monitoring system controller can obtain environmental variable data from at least one sensor or database communicatively coupled to the monitoring system controller. The data points can be obtained for a prescribed interval/period of time, such as between about 1 second and about 10 minutes, or about 1 minute and 7 minutes, or about 5 minutes. The monitoring system controller can then generate a rate of temperature change (IATR) value and a rate of dehumidification change (IDHR) value (Step 901) for each operating cycle or prescribed period of time (cumulative over hour, day, etc). These values can then be averaged over a longer period of time (day, week, month). The measured IATR and IDHR values are then used to compute the dehumidification rate (Step 902) and cooling system sensible heat ratio (Step 903). The measured indoor air temperature, indoor humidity, outdoor air temperature and sensible heat ratio (SHR) can then be applied to a map of product performance and interpolated to determine a system airflow value, wherein the airflow value can be generated (Step 904). In some exemplary embodiments, an outside airflow value into the conditioned space can be determined by plotting outdoor air temperature versus indoor humidity or plotting the outdoor humidity versus the indoor humidity and determining the slope of the best-fit line. The outside airflow can optionally be adjusted using a standard reference condition. In other alternative embodiments, the outside airflow value can be determined by pounds of outdoor moisture per pounds of air versus pounds of indoor moisture per pound of air. All relevant values can then displayed on the System Monitoring Dashboard (Step 905), and an alert or notification can be sent to the user when any of the values exceeds a prescribed limit (Step 906).

Figure 10:
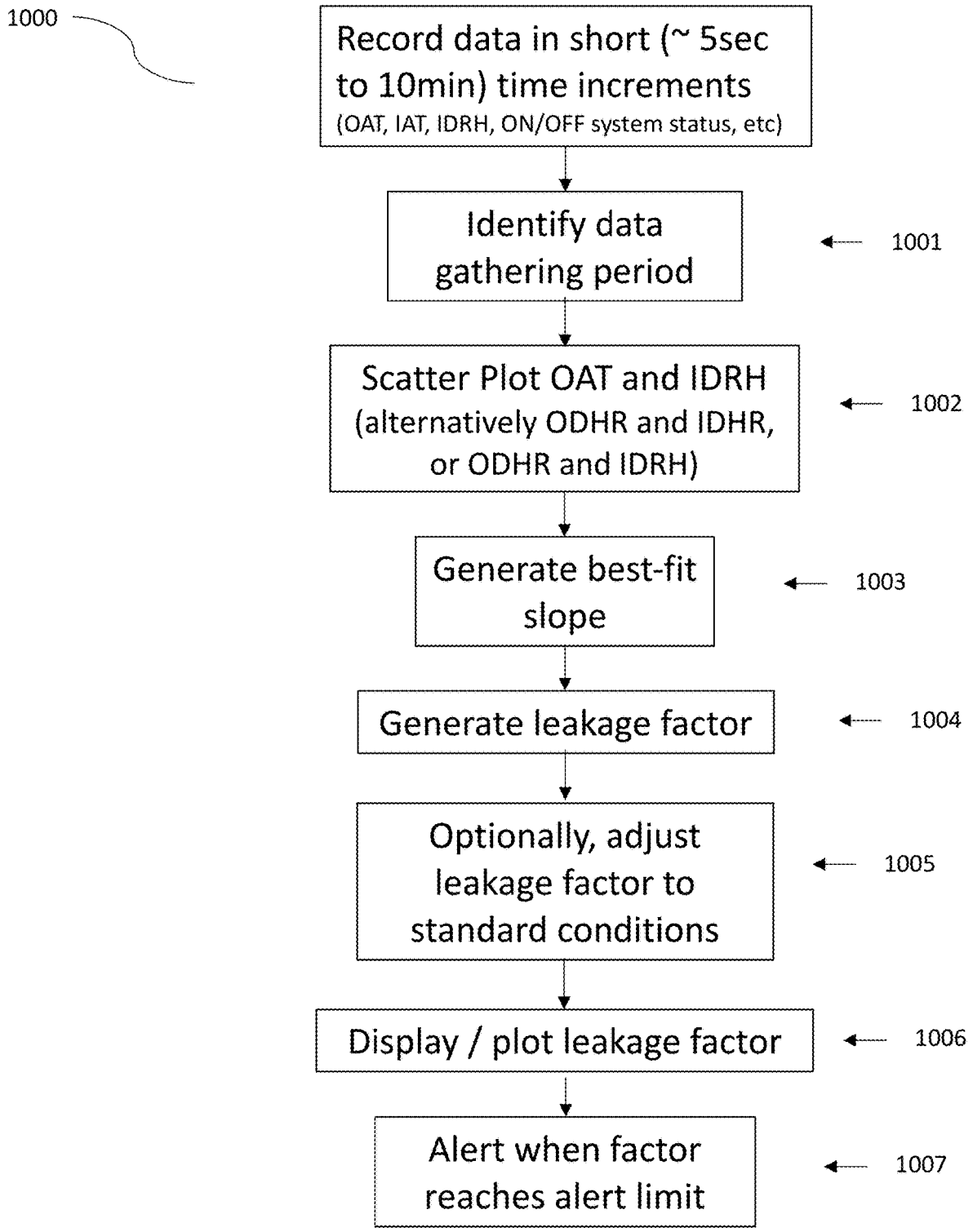
FIG. 10 is a flow chart of an exemplary embodiment of a method for determining outside airflow into conditioned space.

FIG. 10 provides an exemplary method 1000 for ongoing monitoring of outside air flow into a building's conditioned space using a monitoring system controller communicatively coupled to an HVAC system. The monitoring system controller can obtain environmental variable data from at least one sensor or database communicatively coupled to the monitoring system controller. The data points can be obtained for a prescribed interval/period, such as between about 1 second and about 10 minutes, or about 1 minute and 7 minutes, or about 5 minutes. The data points can be measured over a prescribed interval/period, such as one hour, one day, one week, one month and one year (Step 1001). The monitoring system controller can then plot outdoor air temperature against indoor humidity for the prescribed time period (Step 1002) and generate a best-fit slope (Step 1003) to represent a measure of the outside air flow into a building's conditioned space. The resulting slope value can then be used to compute an outside airflow factor/value (Step 1004), which can be optionally adjusted to standard environmental conditions (Step 1005), then displayed on the system monitoring dashboard (Step 1006). An alert or notification can be sent to the user when the leakage value (measured and/or adjusted) exceeds a prescribed limit (Step 1007). The limit can be predetermined by a user and can be based upon the airflow leakage value reaching such limit at a prescribed moment or for a predetermined duration of time. In some exemplary embodiments, the SHR value can be adjusted to an equivalent steady state value based on an average system run-time per cycle to account for startup transient.

The above operations described in FIG. 9 and FIG. 10 can be included on a computer program product that is embodied on a computer readable medium comprising instructions, when executed by a controller or processor can perform the operations described above including, but not limited to recording data elements in prescribed intervals, determining the IATR, IDHR, SHR, latent capacity, airflow and slope value from the data elements obtained during the prescribed interval, optionally plotting the values over time, providing an alert to a user when either of the values reaches a prescribed threshold value, and initiating the computation of new values after an HVAC service or system replacement.

Figure 11:
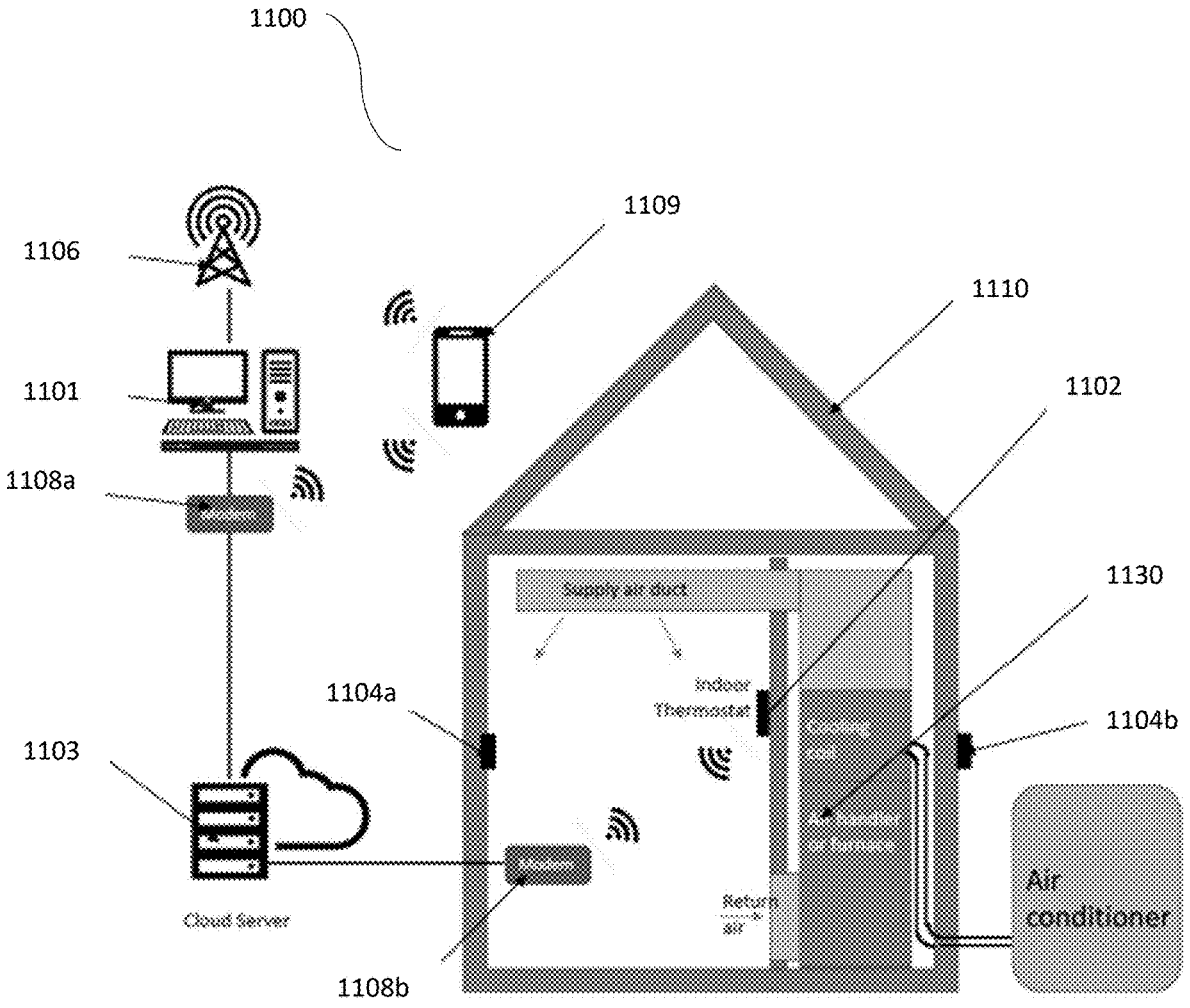
FIG. 11 is an illustration of a schematic of a an exemplary embodiment of an HVAC system of the present disclosure.

As depicted in FIG. 11, the method of the present disclosure can be implemented in a variety of ways, including a cloud application for a monitoring system 1100 of the present disclosure that can be implemented through a computing device or system controller 1101. In some exemplary embodiments, the computing device can be communicatively coupled to an HVAC system 1130, smart thermostat 1102, or other smart device. The HVAC system 1130 can include an incorporated or standalone humidifier. A cloud application can be stored on a memory or a cloud server 1103 which can pull data from a thermostat 1102 or one or more sensors 1104 through a manufacturers API (i.e. API's available to registered third parties), displays the data on a display through any suitable means, such as a web or mobile application, and sends alerts via email, text or mobile notification to a contractor or homeowner's device, or displayed by the HVAC system wall device (user interface or thermostat), or other smart device, such as a phone 1109. The system can include one or more modems, processors, routers, or transceivers 1108 that are communicatively coupled to one or more other elements of the system, including but not limited to the smart thermostat 1102, sensors 1104, controller 1101, server/memory 1103, or smart device 1109. All of the following can utilize a wireless network 1106 to communicated between the various devices. The method could also be implemented directly by the HVAC system, or at the air distribution vents, so long as there are sensors or connectivity that provides the required data. In some exemplary embodiments, the monitoring system controller 1101 can be a cloud-based application housed on an external server or computing device. In other embodiments, the monitoring system controller can be a part of the "smart" thermostat 1102, which can communicate through a network to a third-party via a cloud server 1103 or other means. The thermostat 1102 can have its own dedicated memory or transmit data to a cloud server to store data, algorithms, and other information.

One exemplary embodiment of the system of the present disclosure can include a system controller 1101 including a processor in communication with a memory, and one or more sensors communicatively coupled to the system controller. In some exemplary embodiments, a sensor 1104 can include a "smart" or wirelessly enabled thermostat 1102, smart air vent capable of measuring certain environmental factors, such as the indoor air temperature and the indoor humidity levels of the interior space of a building, or a stand-alone sensor module configured to measure one or more environmental factors. Similarly, a smart thermostat 1102 may be communicatively coupled to one or more sensors 1104 to obtain additional data elements to be used by the system. In some exemplary embodiments, the one or more sensors 1104 can be geographically mapped to a certain location of the environment or structure 1110 that can further be used to make any potential adjustments due to additional environmental factors, including but not limited to sun exposure, humidity, and temperature. In some exemplary embodiments, the system controller 1101 can also be a smart thermostat 1102.

The system controller can also include a transceiver 1108 configured to be communicatively coupled to one or more wireless networks 1106. The wireless network can send and receive communication for other external sources to the system controller. The external sources can include but are not limited to manufacture performance value data, weather data, one or more exterior sensors, and other databases containing HVAC performance data. Similarly, the HVAC performance data can include measured and/or adjusted historical data from the tested HVAC system, which can be used as a reference or for further establishing a baseline HVAC performance value after system maintenance. The one or more external sources can be used to gather information on one or more of the environmental variables and other information the system controller can use to aid in determining HVAC system performance. In one exemplary embodiment, the thermostat unit includes both the system controller as well as one or more sensors.

In another exemplary embodiment, an HVAC system of the present invention can include a system controller 1101 including a processor in communication with a memory, an environment sensor 1104, and a communication module 1108. It will be appreciated that the indoor temperature and humidity sensor(s) may be external of the system controller 1101. In one exemplary embodiment the environment sensor can be a "smart" thermostat that can be communicatively coupled to the system control of the system. The environment sensor can be configured to obtain multiple environmental variables. In one exemplary embodiment, the sensor can obtain the indoor air temperature within the building conditioned by the HVAC system. In one exemplary embodiment, the environmental variables can include the indoor air temperature and indoor humidity. Additionally, other environmental variables can include outdoor air temperature and outdoor humidity. The environmental variable can be used to better accurately model IDHR, Sensible Heat Ratio, circulating airflow and/or outside air entry into the conditioned space on an ongoing basis. Environmental variables that are external of the conditioned space can be obtained using one or more sensors, via wireless network database, or through a network connection to one or more real time databases.

In one exemplary embodiment, the system of the present disclosure can include a monitoring system controller configured to continuously monitor one or more environmental variables and the operation of an HVAC system in relation to the variables. The monitoring system can record and store data of one or more environmental variables, such as outdoor air temperature, outdoor air humidity, indoor air temperature, indoor humidity, and system run status simultaneously. The monitoring system can be set to—record one or more of these variables at a pre-determined time interval, such as between about 1 second to about 10 minutes, or about 5 seconds to about 5 minutes, or about 1 minute to about 2-minute intervals. The monitoring system can then compute and generate IATR and IDHR data points for the pre-determined time intervals and average over a second pre-determined time period. The system can then utilize one or more algorithms to compute the sensible heat ratio, dehumidification rate, airflow and outside air entry into the conditioned space. In some embodiments, the system can utilize product performance data or other data to compute sensible heat ratio and airflow. In other embodiments, the monitoring system can adjust the outside air entry into the conditioned space to a reference condition using one or more algorithms that can be executed by the system controller.

The system can then map/plot IATR, IDHR, sensible heat ratio, dehumidification rate, circulating airflow or outside air entry values over time. A user or the system using outside data, such as a manufacturing setting can set a pre-determined threshold or value limit for either of these values. Upon the system reaching the value limit, the system can alert a user or initiate a display to alert a user of the value limit being reached. In some exemplary embodiments, value limit can correspond to the HVAC system needing to be serviced or evaluated prior to the system failing.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A method for monitoring performance of a heating, ventilation, and air condition system for determining indoor air temperature change rate (IATR) and indoor air dehumidification rate (IDHR) to compute the sensible heat ratio (SHR) of a cooling system for a conditioned space, comprising:

initiating a performance evaluation period through an HVAC controller communicatively coupled to the HVAC system;

monitoring the operation of the HVAC system using a monitoring system controller, wherein a monitoring system controller comprising a processor and memory executes instructions that, during HVAC operation, record outdoor air temperature, indoor air temperature, indoor relative humidity, and HVAC ON/OFF status at a prescribed interval;

obtaining baseline data for one or more environmental factors from at least one of the following:

the HVAC controller communicatively coupled to the monitoring system controller;

one or more sensors communicatively coupled to the HVAC controller; or one or more or databases communicatively coupled to the monitoring system controller;

generating a IATR and IDHR during the performance evaluation period;

generating SHR value at intervals during the performance evaluation cycle using a performance analysis algorithm and at least one of the following environmental factors:

obtained environmental data;

historical measured performance data for the HVAC system; or manufacturer system performance product data; and generating an airflow value based upon the SHR value, wherein an outside airflow value into the conditioned space can be determined by plotting outdoor air temperature versus indoor humidity and determining the slope of the best-fit line;

and generating, via a user interface, an alert when the circulating airflow value or the normalized outside-air entry exceeds a predetermined threshold for a predetermined duration.

2. The method of claim 1, wherein the SHR value is adjusted to an equivalent steady state value based on an average system run-time per cycle to account for startup transient.

3. The method of claim 1, wherein the SHR values used to generate the airflow value are based upon SHR values within a pre-determined range.

4. The method of claim 1, wherein a cooling system airflow is determined using the SHR value and one or more of the following factors: measured indoor air temperature, outdoor air temperature and indoor humidity values applied to cooling system performance data.

5. The method of claim 1, wherein an outside airflow value into the conditioned space can be determined by plotting outdoor air temperature versus indoor humidity and determining the slope of the best-fit line.

6. The method of claim 1, wherein an outside airflow value into the conditioned space can be determined by plotting outdoor humidity vs. indoor humidity and determining the slope of the best-fit line.

7. The method of claim 1, wherein the outside airflow value into the conditioned space is adjusted using a standard reference condition, wherein the HVAC controller automatically adjusts according to the alert.

8. The method of claim 1, wherein the outside airflow value is determined by pounds of outdoor moisture per pounds of air versus pounds of indoor moisture per pound of air.

9. The method of claim 1, wherein a circulating airflow value is recorded and plotted over a pre-determined period of time, and further comprising computing indoor wet-bulb temperature from the measured indoor air temperature and indoor relative humidity and, using manufacturer system performance product data, determining a circulating airflow value by interpolating the performance data with the computed indoor wet-bulb, the measured outdoor air temperature, and the computed SHR.

10. The method of claim 9, wherein the circulating airflow value is further adjusted based upon the following equation: Adjustment=[(IATmeasured−OATaverage)/(IATmeasured−OATmeasured)]$^{1/2}$, wherein IAT is indoor air temperature and OAT is outdoor air temperature.

11. The method of claim 1, wherein the monitoring system is further communicatively coupled to a database to retrieve manufacturer performance data over a network API.

12. The method of claim 1, further comprising generating the IATR and the IDHR from the recorded time-series data, wherein the prescribed interval is between about 5 seconds and about 5 minutes.

13. A method for monitoring performance and determining indoor air temperature change rate (IATR) and indoor air dehumidification rate (IDHR) to account for exterior airflow within a conditioned space, comprising:

initiating a performance evaluation period through an HVAC controller communicatively coupled to the HVAC system;

monitoring the operation of the HVAC system using a monitoring system controller wherein a monitoring system controller comprising a processor and memory executes instructions that, during HVAC operation, record outdoor air temperature, indoor air temperature, indoor relative humidity, and HVAC ON/OFF status at a prescribed interval;

obtaining baseline data for one or more environmental factors from at least one of the following:

the HVAC controller communicatively coupled to the monitoring system controller;

one or more sensors communicatively coupled to the HVAC controller; or one or more or databases communicatively coupled to the monitoring system controller;

generating a IATR and IDHR during the performance evaluation period;

generating at least one of the following values:

circulating airflow value or an outdoor airflow, wherein the outside airflow value into the conditioned space can be determined by plotting outdoor air temperature versus indoor humidity and determining the slope of the best-fit line; and generating, via a user interface, an alert when the circulating airflow value or the normalized outside-air entry exceeds a predetermined threshold for a predetermined duration.

14. The method of claim 13, wherein the outside airflow value into the conditioned space can be determined by plotting outdoor humidity vs. indoor humidity and determining the slope of the best-fit line.

15. The method of claim 13, wherein the circulating airflow value is determined by generating SHR values at intervals during the performance evaluation cycle using a performance analysis algorithm and at least one of the following environmental factors:

obtained environmental data;

historical measured performance data for the HVAC system; or manufacturer system performance product data.

16. The method of claim 15, wherein the SHR value is adjusted to an equivalent steady state value based on an average system run-time per cycle to account for startup transient.

17. The method of claim 15, wherein the SHR values used to generate the circulating airflow value are based upon SHR values within a pre-determined range.

18. The method of claim 15, wherein the circulating airflow value is determined using the SHR value and one or more of the following factors: measured indoor air temperature, outdoor air temperature and indoor humidity values applied to cooling system performance data.

19. A system for monitoring and evaluation of an HVAC system for a conditioned space, comprising:

a monitoring system controller having a processor and memory, wherein the HVAC system further includes an HVAC controller, wherein executes instructions to record outdoor air temperature, indoor air temperature, indoor relative humidity, and ON/OFF system status at a prescribed interval;

at least one sensor communicatively coupled to the monitoring system controller, wherein the sensor is configured to monitor one or more environmental parameters inside a structure;

a memory; and a transceiver configured to communicate with one or more external sources for obtaining monitoring data including at least one of the following:

environmental information;

HVAC performance data provided by a manufacturer; or measured HVAC data;

wherein the monitoring system controller is configured to generate at least one of the following:

adjusted air temperature change rate (IATR) value (IATR-adj), indoor air dehumidification rate (IDHR), Sensible Heat Ratio (SHR), circulating airflow and/or outside air entry into the conditioned space on an ongoing basis, and wherein the outside airflow value into the conditioned space can be determined by plotting outdoor air temperature versus indoor humidity and determining the slope of the best-fit line; and generating, via a user interface, an alert when the circulating airflow value or the normalized outside-air entry exceeds a predetermined threshold for a predetermined duration.

20. The system of claim 19, wherein the environmental information comprises at least one of the following: indoor air temperature, outdoor air temperature, indoor humidity, outdoor humidity, or barometric pressure.

* * * * *